US005407366A

United States Patent [19]

Briones et al.

[11] Patent Number: 5,407,366

[45] Date of Patent: Apr. 18, 1995

[54] COMBINATION CONNECTOR

[75] Inventors: Francisco R. Briones, Markham; Kamal S. Boutros, Richmond Hill, both of Canada

[73] Assignee: Amphenol Corporation, Wallingford, Conn.

[21] Appl. No.: 252,425

[22] Filed: Jun. 1, 1994

Related U.S. Application Data

[63] Continuation-in-part of Ser. No. 219,161, Mar. 28, 1994.

[51] Int. Cl.[6] ..... H01R 13/658

[52] U.S. Cl. ..... 439/639; 439/607; 439/620

[58] Field of Search ..... 439/675, 581, 638, 639, 439/540, 607, 701, 535, 95, 101

[56] References Cited

U.S. PATENT DOCUMENTS

| | | | |
|---|---|---|---|
| 3,879,103 | 4/1975 | Peltola et al. | 439/581 |
| 3,932,020 | 1/1976 | Gilbert, Jr. | 439/675 |
| 3,980,382 | 9/1976 | Reeder | 439/581 |
| 4,412,717 | 11/1983 | Monroe | 439/582 |
| 4,500,159 | 2/1985 | Briones et al. | 439/607 |
| 4,618,207 | 10/1986 | Silbernagel | 439/676 |
| 4,629,266 | 12/1986 | Viselli | 439/81 |
| 4,666,231 | 5/1987 | Sheesley et al. | 439/581 |
| 4,690,479 | 9/1987 | Hollyday et al. | 439/97 |
| 4,695,105 | 9/1987 | Ney et al. | 439/95 |
| 4,695,115 | 9/1987 | Talend | 439/76 |
| 4,712,849 | 12/1987 | Seidel et al. | 439/607 |
| 4,726,638 | 2/1988 | Farrar et al. | 439/620 R |
| 4,772,224 | 9/1988 | Talend | 439/607 |
| 4,795,352 | 1/1989 | Capp et al. | 439/63 |
| 4,799,901 | 1/1989 | Pirc | 439/620 |
| 4,804,332 | 2/1989 | Pirc | 439/620 |
| 4,842,529 | 6/1989 | Frantz et al. | 439/95 |
| 4,850,902 | 7/1989 | Reed | 439/676 |
| 4,884,982 | 12/1989 | Fleming et al. | 439/620 |
| 4,923,310 | 5/1990 | Sekiguchi et al. | 439/701 |
| 5,057,041 | 10/1991 | Yu et al. | 439/620 |
| 5,062,811 | 11/1991 | Hackman | 439/620 |
| 5,073,123 | 12/1991 | Birch et al. | 439/188 |
| 5,083,945 | 1/1992 | Miskin et al. | 439/607 |
| 5,102,354 | 4/1992 | Crane et al. | 439/620 |
| 5,108,300 | 4/1992 | Weber | 439/188 |
| 5,125,854 | 6/1992 | Bassler et al. | 439/607 |
| 5,143,868 | 9/1992 | Caveney et al. | 439/638 |
| 5,145,412 | 9/1992 | Tan et al. | 439/620 |
| 5,158,480 | 10/1992 | Blondeel et al. | 439/607 |
| 5,167,536 | 12/1992 | Wang | 439/620 |
| 5,192,228 | 3/1993 | Collins et al. | 439/607 |
| 5,207,597 | 5/1993 | Kline | 439/607 |
| 5,288,246 | 2/1994 | Whiteman, Jr. et al. | 439/540 |
| 5,290,175 | 3/1994 | Robinson et al. | 439/540 |
| 5,326,280 | 7/1994 | Briones et al. | 439/581 |

FOREIGN PATENT DOCUMENTS

| | | |
|---|---|---|
| 53-86387 | 7/1978 | Japan . |
| 2169156 | 7/1986 | United Kingdom . |

OTHER PUBLICATIONS

National Tel-Tronics product brochure "The New Wave in Coaxial Connectors".

*Primary Examiner*—Gary F. Paumen
*Attorney, Agent, or Firm*—Bacon & Thomas

[57] ABSTRACT

In order to save space and reduce the number of parts needed to mount a plurality of connector types on a circuit board, the different connector types share a common molded housing, and at least two of the connector types share a common shield which may include an integral board lock and which can also be arranged to facilitate mounting filter components in one or more of the connector types. The connector types may include a BNC coaxial cable connector, a modular phone jack connector, and a multiple pin D-sub connector, with the BNC and modular jack connector sharing the common shield. In the case of the BNC connector, both the inner and outer insulators are integrally molded with the one-piece housing.

9 Claims, 3 Drawing Sheets

COMBINATION CONNECTOR

This application is a continuation-in-part of application Ser. No. 08/219,161, filed Mar. 28, 1994.

BACKGROUND OF THE INVENTION

1. Field of the Invention

The invention relates to electrical connectors, and in particular to electrical connectors of the type used to couple data communications cables with circuitry on a network or communications interface card.

2. Description of Related Art

The demand for cables and connectors capable of transferring data between computers and peripherals has increased exponentially in recent years as the advantages of networked systems of personal computers, and access to the so-called information highway, have become increasingly evident to users. Despite the increasing popularity of modem communications and networked computer systems, however, and the corresponding tendency towards standardization of system components, there currently exists a wide variety of different cable and connector types, with none likely to attain exclusivity in the foreseeable future. The different cable types currently in widespread use include twisted pair cables and coaxial cables for serial communications, and numerous different multiple wire configurations for parallel communications.

In general, twisted pair cables are coupled to a network or data communications interface via connectors of the type popularly referred to as modular phone jack connectors because of their resemblance to the standard four wire telephone jack connector. This type of connector is commonly denoted by the letters RJ, followed by a numerical indicator (e.g., the RJ 45 connector often used in Ethernet applications). An example of a state-of-the-art modular jack connector with advanced filtering capabilities is found in copending U.S. patent application Ser. No. 08/043,544.

Coaxial cable connections are usually accomplished by a type of connector known as the BNC connector. An example of a state-of-the-art BNC connector with advanced filtering capabilities is shown in copending U.S. patent application Ser. No. 08/075,876.

Multiple wire cables, on the other hand, utilize a variety of different multiple pin connectors, including mini-DIN connectors and D-sub connectors such as the RS-232 standard 25 pin (DB25) connector, or the 15 pin (DB15) connector commonly used in Ethernet cards. Depending on the specific needs of the user, these connectors may be either shielded or unshielded, and may or may not include filter components such as capacitors.

Although each different cable type requires a different connector, the use of separate interface cards for each type of cable or connector is unnecessarily redundant, and thus it is common to provide more than one type of connector on a single card in order to enable the card to communicate with compatible devices which differ only in the choice of cable or connector required. The Ethernet network interface, for example, can interchangeably use all three of the above-mentioned types of cable and thus, in order to provide compatibility with a maximum number of external devices, it is common to provide as many as three different types of connectors on a single Ethernet interface or adapter card.

Fortunately for interface card manufacturers, the three most common types of connectors-modular jack connectors, BNC connectors, and D-sub parallel connectors-are small enough to fit side-by-side on a standard network card. Conventionally, this is accomplished without modifying the connectors. However, it turns out, for reasons which were not previously appreciated by those skilled in the art, that placement of the three standard connectors on a card without modification is a less than optimal configuration.

The first reason why it is disadvantageous to place multiple connectors on a single card without modification of the connectors has to do with the cost of the circuit board on which the connectors are placed. This cost, previously ignored by connector designers, is significant. Even though the space occupied by multiple connectors placed side-by-side on an interface card may be acceptable from the standpoint of compatibility with available slots in the device within which the card is to be used, this space necessitates a larger board than might otherwise be required. Even small decreases in the total footprint of the connectors can result in significant savings in materials costs. For example, printed circuit board materials presently cost approximately $0.12 per square inch. This is a very high cost when one considers the volume of cards sold and the overall price of each card, and thus it would be very desirable to reduce the size of the card as much as possible. A reduction in width of one half inch for a typical eight inch interface card saves, at approximately $0.48 in material costs per card.

The second reason why placement of multiple connectors on a card without modification is lees than optimal is that the provision of three connectors on a card results in redundancies, previously unrecognized, which could be eliminated by sharing certain components between connectors, in particular housings, shielding, and the board locks used to mount the connectors on the card.

SUMMARY OF THE INVENTION

It is accordingly a first objective of the invention to provide a connector configuration for a circuit board or card which requires less space than conventional configurations.

It is a second objective of the invention to provide a connector configuration for a circuit card in which redundancy is eliminated by sharing components between the connectors.

It is a third objective of the invention to provide a combined modular jack, BNC, and D-sub connector for use on a circuit card, which requires less space than standard configurations and which eliminates redundancies.

It is a fourth objective of the invention to provide a combined modular jack and BNC connector for use on a circuit card, which requires less space than standard configurations and which eliminates redundancies.

It is a fifth objective of the invention to provide a single connector configuration for a circuit card capable of providing modular phone jack, BNC and/or D-sub connections, both shielded and unshielded, with or without filtering.

It is a sixth objective of the invention to provide a BNC connector in which all dielectric parts are provided by a single mold.

These objectives are accomplished, in preferred embodiments of the invention by providing a combined modular phone jack, BNC, and/or multiple pin connector having a single molded housing and a common shield for the BNC and modular phone jack portions of the combined connector.

In especially advantageous embodiments of the invention, additional reductions in the number of parts are achieved by, respectively, forming a board lock integrally with the common shield, and forming both the inner and outer insulators of the BNC section of the connector, which are conventionally formed separately, as integral parts of the single molded housing structure. These designs not only have the advantage of using less space and less parts, but also has the advantage of requiring fewer and simpler assembly steps than are required for separate assembly of the three individual types of connectors as currently configured.

DETAILED DESCRIPTION OF THE PREFERRED EMBODIMENTS

Figure 1:
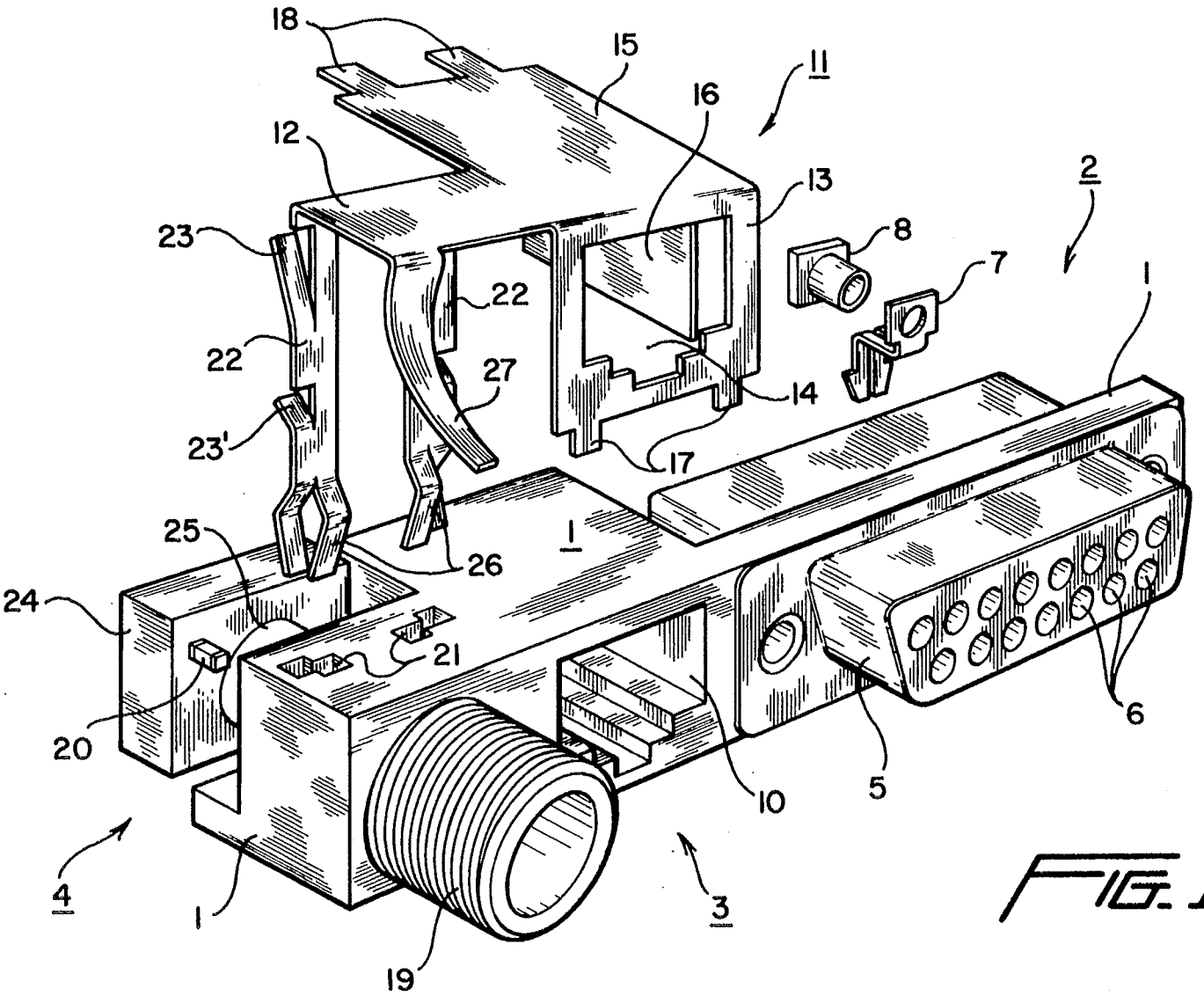
FIG. 1 is a perspective view of a connector constructed in accordance with the principles of a preferred embodiment of the invention.

As shown in FIG. 1, the connector of the first preferred embodiment includes a combined housing 1 having a D-sub housing section 2, a modular jack housing section 3, and a BNC housing section 4. The shared housing 1 is preferably molded from a suitable plastic, in which case the housing can easily be made in a variety of configurations for different connector types, the illustrated types being typical of a network interface The D-sub section 2 of the first preferred embodiment is conventional in nature, except that its housing is integral with the housing of the modular jack section. Included in this section are a conventional metal shield 5 which surrounds a D-shaped front portion including apertures 6 for receiving correspondingly shaped male or female connector contacts (not shown). Unlike the standard D-sub connector, however, the illustrated D-sub connector section 2 requires only a single board lock 7 for securing the D-sub section on the board. An optional connecting pin 8 for electrically connecting shield 5 with the board lock to provide a ground path therethrough when the board lock is secured to the circuit board may also be provided. Those skilled in the an will recognize that the configuration of the rear portion of the connector section, which is arranged to permit connections between the contacts and the board, is conventional and may be varied according to the specific requirements of the type of D-sub being implemented.

The modular jack section 3 of the connector has a shape identical to the shape of the standard modular jack connector, except that the housing is integrally molded with connector section 2 and 4. The jack receiving aperture 10 in the front of the section, and all internal components (not shown) are identical to those found in conventional jack connectors. The principal departure from conventional connectors in this section of the combination connector is that, instead of a conventional stamped and formed shield case which fits over at least four sides of the housing, a modified shield 11, which is also preferably stamped and formed, is provided which is shaped to take into account the fact that only three walls of the section are exposed, and which includes an extension 12 for providing, as will be explained below, grounding in the BNC section 4 of the combination connector.

The portion of shield 11 which covers exposed walls of the modular jack section 3 includes a planar front portion 13 having a cutout 14 corresponding to the aperture 10 in the modular jack, a top portion 15 extending transversely to the front portion 13 which completely covers the top of modular jack section 3, and a single side portion 16 extending transversely to both the top and front portions of section 3, portion 16 being designed to fit between the D-sub connector section 2 and the modular jack section 3. Also included in the illustrated embodiment are pairs of tabs 17 and 18 which can be bent respectively over the bottom and back of the modular jack section to secure the shield on the housing, although those skilled in the art will appreciate that numerous other arrangements for securing the shield on the housing may also be utilized.

Shield 11 includes a lateral extension 12, as noted above, which covers the top of the main body of BNC connector section 4 for use as a ground connection in case the BNC connector is filtered. The filtering arrangement and other aspects of the BNC section, including the shape of a threaded front mating portion 19, are similar to those disclosed in U.S. patent application Ser. No. 08/075,876, and includes filter components, e.g., chip capacitors 20 inserted into slots (not shown) which extend parallel to the direction of the BNC contact and which communicate with vertical passages 21 formed in the connector housing. Lateral extension 12 of shield 11 includes further extensions 22 which fit into passages 21 and which include upper fines 23 and lower fines 23' arranged to extend into corresponding ones of the chip capacitor slots when extensions 13 are inserted into passages 21, thereby biasing any chip capacitors present in the slots against a parallelepiped shaped rear portion 24 of a metal BNC contact 25 of the type disclosed in the above-mentioned application Ser. No. 08/075,876.

The shield 11 also advantageously includes an integral board lock in the form of bifurcated portions 26 at the distal ends of extensions 22. Bifurcation of the ends of extensions results in the formation of fingers which can bend inwardly upon passage through a hole in a circuit board and then outwardly when the hole is cleared to lock the connector on the board in the manner of conventional board locks, but without the need for an extra piece or assembly step. Also included in the shield is a panel-engaging extension 27 similar to those described in copending patent application Ser. No. 08/075,876 for providing a ground path from the shield 11 to a panel on the circuit card or device to which the connector is mounted.

Figure 2:
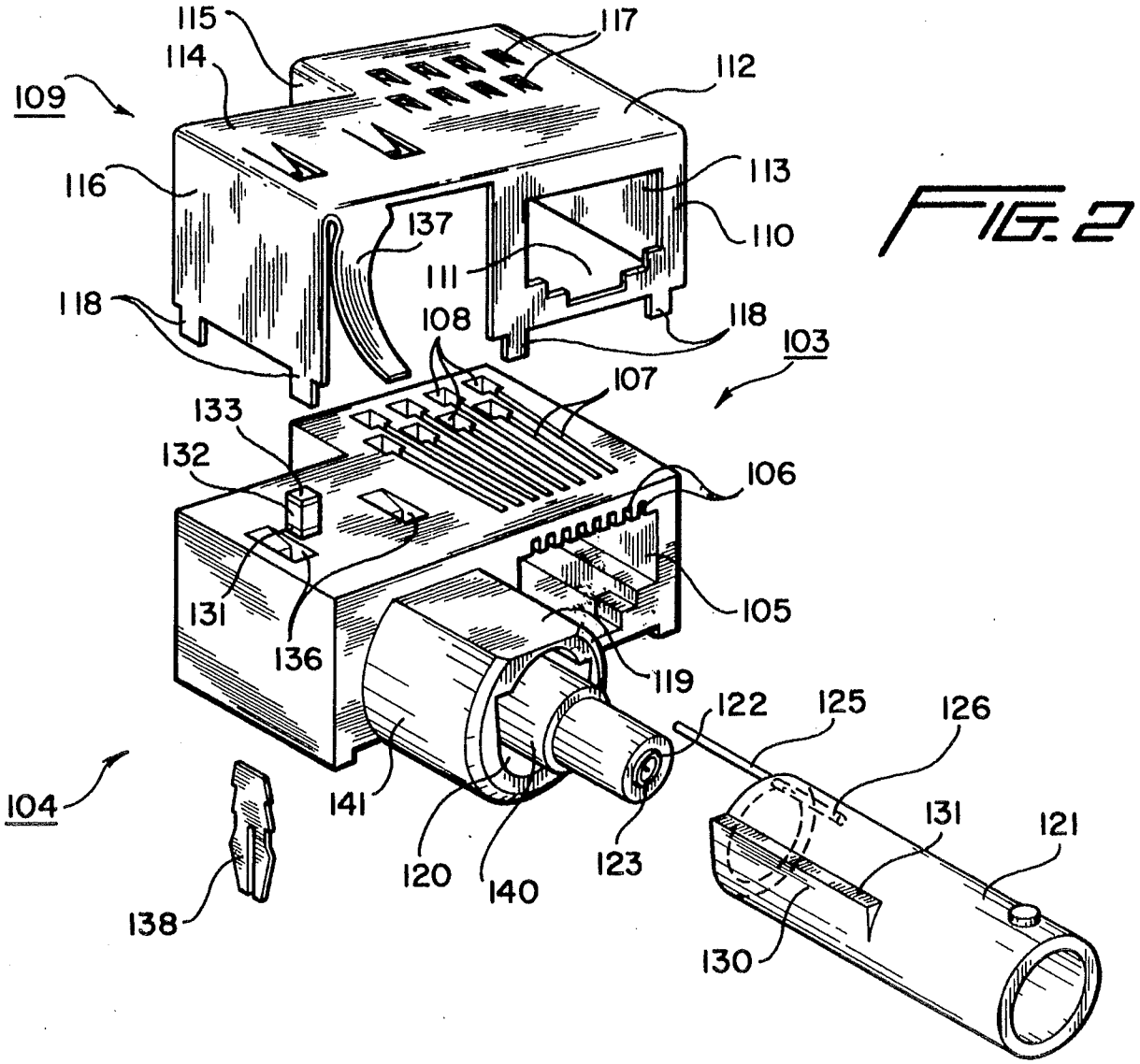
FIG. 2 is a perspective view of a connector constructed in accordance with the principles of a second preferred embodiment of the invention.
Figure 3:
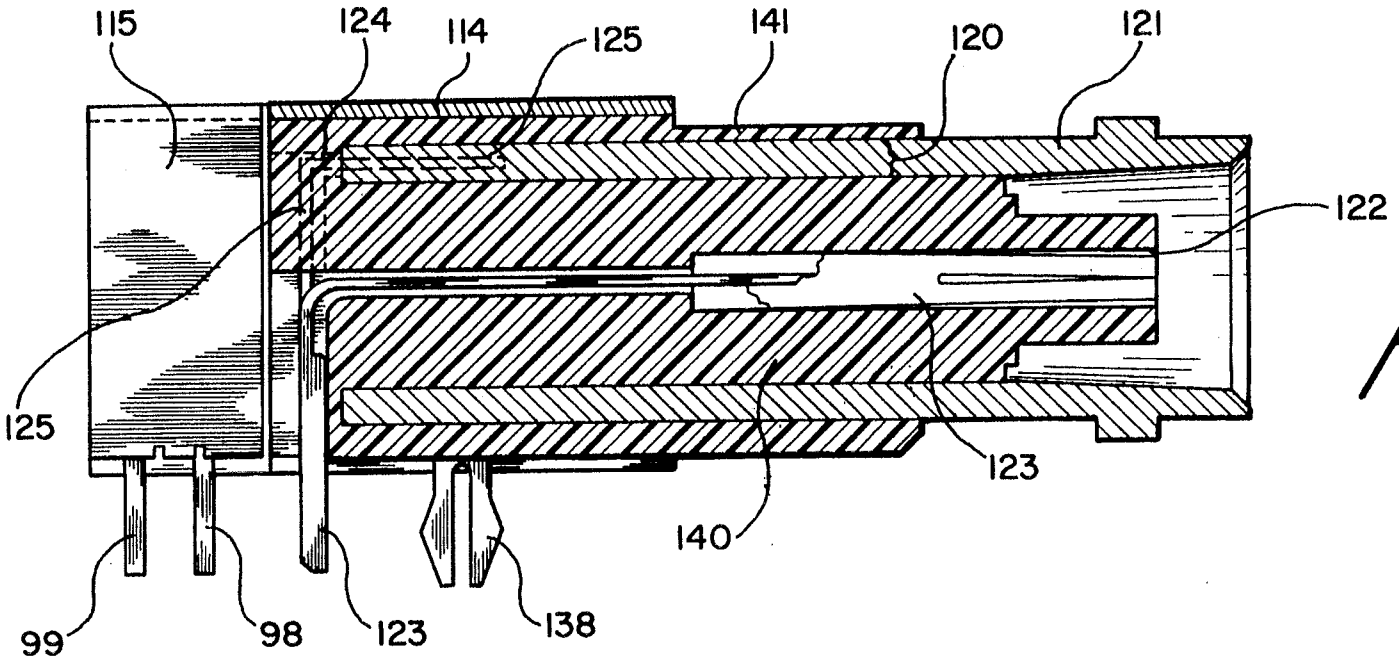
FIG. 3 is a cross-sectional side view of the connector shown in FIG. 2.
Figure 4:
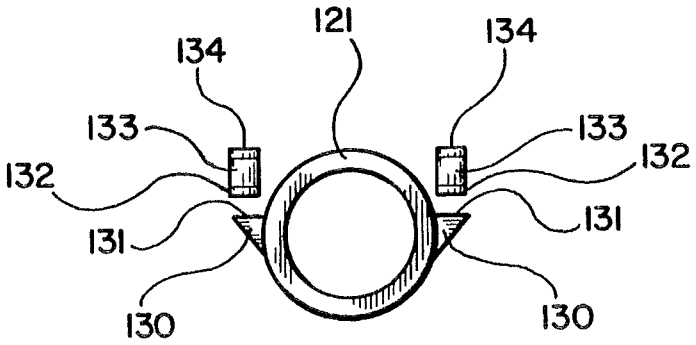
FIG. 4 is a front view of the outer contact for the BNC portion of the connector of FIG. 2.

Referring now to FIGS. 2–4, a combination connector according to a second preferred embodiment of the invention includes a modular jack housing section 103 having a shape identical to the shape of a standard modular jack connector, except that the housing section is integrally molded with BNC connector housing section 104. Except as noted below, all components of both the modular jack section and the BNC housing section are standard, and thus only those features which represent improvements over conventional connectors of the subject types, or which are necessary for an understanding of the invention, are illustrated.

The body of the modular jack portion 103 of the combination connector illustrated in FIGS. 2 and 3 is identical to the modular jack disclosed in copending U.S. patent application Ser. No. 08/043,544, and includes a jack receiving aperture 105, openings 106 at the top of aperture 105, and grooves 107 in the top surface of the jack section for receiving contacts 98 and 99 having a generally standard configuration. Extending into the top surface of the jack section 103, towards the rear, are openings 108 into which may be placed filter elements (also not shown). As explained in the copending application, the contacts are positioned such that, when filter elements are place in the openings, electrodes on the filter elements engage the contacts.

As in the previous embodiment, the combination connector of this embodiment includes a single stamped and formed shield member 109 which includes a front wall 110 having a cutout or opening 111 corresponding in shape to the shape of the jack-receiving aperture 105, a top 112, a side wall 113, and an extension 114 of the top which covers the top surface of the BNC section 104 of the combination connector. Also part of the single shield member 109 are side walls 115 and 116 for respectively shielding remaining exposed sides of the modular jack and BNC sections of the connector. In addition, the shield member may include extensions (not shown) at the rear of the respective connector sections. As is apparent in FIG. 2, front wall 110, top portions 112, 114, and side walls 113, 115, and 116 are all mutually perpendicular.

The top of the shield member also includes, in the illustrated embodiment, downwardly extending tines 117 for engaging, in the manner disclosed in copending application Ser. No. 08/043,544, ground electrodes on any filter elements which have been inserted into openings 108. The shield member may be secured to the housing by tabs 118 which can be bent at a ninety degree angle to engage the bottom of the connector once the shield has been positioned on the housing, although those skilled in the art will appreciate that numerous alternative means may be sued to secure the shield on the connector.

The BNC section 104 of the combination connector includes two unique features which may also be used in stand-alone BNC connectors:

The first of these particularly unique and advantageous features is that all insulating portions of the BNC section, including the conventionally separate insulators 161 and 162, respectively, which surround the inner and outer coaxial contact, are molded in a single mold. Thus, the entire connector, including both the jack and BNC portions may be produced in a single step, without even the need for separate molding and assembly of the inner insulator.

This feature is accomplished, as is best shown in FIG. 3, by forming a single front insulating portion 119 of BNC section 103 with an annular groove 120 for accommodating the outer contact 121 and which separates insulators 140 and 141, and a cylindrical bore 122 in the portion of the insulator which lies within the groove 120 for accommodating the inner contact 123, and providing at the rear of the groove 120 which accommodates the outer contact 121 a through-hole 124. The outer contact 121 can thus be connected to the circuit board (not shown) on which the combination connector is mounted by providing an extension or a discrete contact pin 125 secured in bore 126 in the outer contact, and which is inserted through through-hole 124 as outer contact 121 is positioned from the front of the connector during assembly in the annular groove. After insertion, pin 125 is normally bent so that it extends downward past the rear of the BNC section to engage the circuit board, although those skilled in the art will appreciate that the principles of the invention will also apply to a vertical, as opposed to right angle, connector configuration (particularly in the case of a stand-alone BNC connector), in which case pin 125 would not be bent. As is conventional, the inner contact also includes an extension which is bent downward after insertion of the inner contact to engage an appropriate lead on the circuit board.

Filter capabilities are provided, according to a second unique and particularly advantageous feature of this embodiment, by an especially simple structure involving the inclusion of flanges 130 on the outer contact 121, as shown in FIGS. 2 and 4. Flanges 130 have an upwardly facing planar surface 131 for contacting the live electrode 132 of a chip capacitor or other filter element 133 placed into openings 136. The ground connection provided by the filter elements can then be completed simply by causing downwardly extending tines 134 cut out of the shield member 109 to engage a ground electrode 135 on the filter element, the fine biasing the filter element against the planar surface of outer contact 121 contact.

Also included as part of shield member 109 of this embodiment is a panel-engaging tongue 137 for directly grounding the shield member to a panel provided on the interface card, in the manner disclosed in copending application Ser. No. 08/075,876. Finally, while a separate board lock 138 is illustrated for this embodiment, it would of course also be possible to modify the shield casing to include a board lock in the manner similar to that of the first embodiment.

Those skilled in the art will appreciate that while filtering is required for some applications, the filter components may be omitted in others. Nevertheless, because the inclusion of component slots during the housing molding process requires no extra steps, and because mounting of the shield on the connector requires the same number of steps regardless of whether the filter components are included, the same housing and shield structure may be used for either the filtered or unfiltered situation, and the scope of the invention is intended to encompass both situations.

It is apparent from the above description that the connectors of the preferred embodiments contain an absolute minimum of parts. A list of parts which must be assembled for the two embodiments is as follows:

1. a plastic housing for both the RJ 45 jack and the BNC connector, which may include both the inner and outer BNC insulators (those skilled in the art will appreciate that the one piece insulator design used in the second embodiment may also be adapted for the first embodiment), and
2. a shield casing common to both connectors which also facilitates filtering.

The only remaining elements necessary to complete functional connectors are the modular jack and BNC contacts. To add filtering, the assembler merely needs to insert capacitor chip or other appropriately sized filter chips into openings provided in the modular jack and BNC sections of the respective preferred connectors. No extra parts are required.

In order to assemble the preferred connectors, the modular jack, BNC, and, if applicable, multiple pin parallel-type connector contacts need to be inserted into the respective connector sections, followed by insertion of any desired filter chips, and placement of the combined shield casing over the plastic insulative one-piece molded housing. Thus just two basic assembly steps (three if filtering is desired, are necessary to complete assembly of a fully functional combination connector.

Because the modular jack shield and BNC ground connection are stamped from a single sheet of conductive metal, and because of the shared walls, less metal is required and at the same time a single assembly step suffices to provide both the necessary shielding for both the modular jack and the grounding for the BNC connector. Those skilled in the art will, however, appreciate that numerous variations in the concept of a common shield can be provided, including designs which merely provide a shielding function rather than a filming function, and designs for various types of connectors other than the three types of connectors shown. As a result of such possible modifications, and others which will undoubtedly occur to those skilled in the art, it is intended that the invention not be limited by the above description or the attached illustration, but rather that it should be limited solely in accordance with the appended claims.

We claim:

1. A combination connector, comprising:

a BNC connector and a modular jack connector each connector having a respective housing section, the housing sections being molded together as one piece to form a single molded housing.

2. A connector as claimed in claim 1, further comprising a multiple pin parallel-type connector which also shares said single molded housing.

3. A connector as claimed in claim 1, wherein the BNC connector includes means for providing a ground path between components in the connector and a panel to which the BNC connector is mounted, wherein the modular jack connector includes a shielding member, and wherein said grounding means is formed by an extension of said shielding member.

4. A connector as claimed in claim 3, wherein the BNC connector is a filter connector.

5. A connector as claimed in claim 4, wherein the housing includes an opening for a BNC contact, a plurality of component slots extending parallel to an axis of the contact, and a plurality of passages in communication with said slots and extending transversely to the slots, wherein said slots provide means for receiving chip capacitors and said transverse passages provide means for receiving further extensions of said shield extension, said further extensions including tabs for engaging electrodes on said chip capacitors when said chip capacitors are positioned in said slots and for biasing the chip capacitors such that second electrodes of said chip capacitors extend through said slots to engage a portion of the BNC contact, a path thereby being formed which extends from said contact through said components to the further extensions, a main portion of the extension, and thence to said panel upon engagement of the shielding member with the panel.

6. A connector as claimed in claim 5, wherein at least one of said further extensions of the shielding member is bifurcated to form, at a distal end thereof, an integral board lock.

7. A connector as claimed in claim 3, wherein said outer contact of the BNC connector includes planar surfaces for supporting a live electrode of a filter chip, wherein said housing includes apertures in which said filter chip is inserted, and wherein said shielding member includes downwardly extending tabs which extend into said apertures and engage a ground electrode of the filter chip when said shielding member is mounted on said housing.

8. A connector as claimed in claim 3, comprising a further extension of said shield extension, said further extension being arranged to extend through a passage in the housing, wherein the further extension is bifurcated to form, at a distal end thereof, an integral board lock.

9. A connector as claimed in claim 1, wherein said BNC connector includes an inner contact and an outer contact separated by an inner insulator, and an outer insulator surrounding said outer contact, and wherein said inner and outer insulators are both molded together with said housing, said inner insert including an opening for said inner contact and said inner and outer insulators forming an annular aperture for the outer contact, a rear wall of said annular aperture including an opening through which is inserted a ground pin extending from said outer contact.

* * * * *